US005208936A

United States Patent [19]

Campbell

[11] Patent Number: 5,208,936

[45] Date of Patent: May 11, 1993

[54] VARIABLE SPEED PIG FOR PIPELINES

[76] Inventor: Douglas C. Campbell, 30 Sandpiper Drive, Sherwood Park, Alberta, Canada, T8A 0B8

[21] Appl. No.: 697,411

[22] Filed: May 9, 1991

[51] Int. Cl.[5] ..... B08B 9/04

[52] U.S. Cl. ..... 15/104.061; 166/153

[58] Field of Search ..... 15/104.061, 104.062, 15/104.063, 3.5, 3.51; 137/268; 134/8; 166/153, 170, 176, 177

[56] References Cited

U.S. PATENT DOCUMENTS

| | | | |
|---|---|---|---|
| 2,860,356 | 11/1958 | Matheny | 15/104.061 |
| 3,088,491 | 5/1963 | En Dean | 15/104.061 |
| 3,495,546 | 2/1970 | Brown et al. | 15/104.061 |
| 3,496,588 | 2/1970 | Ver Nooy | 15/104.061 |
| 4,365,379 | 12/1982 | Neff | 15/104.061 |

*Primary Examiner*—Edward L. Roberts
*Attorney, Agent, or Firm*—Christensen, O'Connor, Johnson & Kindness

[57] ABSTRACT

A variable speed pig for a pipeline includes a housing having at least one and preferably several flow through passageways. The size of the flow through passageways is varied according to the desired speed of the pig. The pig includes an annular seal disposed about the housing for sealing engagement with the pipeline and the housing, and the flow through passageways are selectively blocked by a first plate disposed in the housing, the first plate having a plurality of first openings. A second plate is also disposed in the housing, and the second plate has a plurality of second openings that are aligned in fluid connection with the flow through passageways. The first plate is movable in relation to the second plate from a position in which at least some of the first and second openings are in fluid connection to a position in which substantially none of the first and second openings are in fluid connection. The plates may be adjusted by a step motor and controller which are in turn controlled by a comparator circuit that compares the actual speed of the pig with the desired speed. The collective effective cross-sectional areas (size) of the flow through passageways is decreased when the actual speed is lower than the desired speed by more than the pre-set amount and increased when the actual speed is higher than the desired speed by a pre-set amount.

11 Claims, 5 Drawing Sheets

VARIABLE SPEED PIG FOR PIPELINES

FIELD OF THE INVENTION

This invention relates to pigs used in pipelines.

BACKGROUND AND SUMMARY OF THE INVENTION

Pigs are devices that are propelled under the pressure of gas or liquid in a pipeline along the pipeline for various servicing purposes. The pig may tow other tools, for example smart pigs that analyze the condition of the inside of the pipeline, or it may stand alone and for example push debris along the pipeline and away from low spots in the pipeline. When used for towing smart pigs, it is desirable that the pig maintain a constant preset speed in the range for example of 4–6 mph.

There has therefore developed a need for a pig that maintains a constant speed in a pipeline, and in which the speed may be pre-set. While some have been proposed, those that the applicant is aware of have had shortcomings.

There is therefore provided in one embodiment a variable speed pig for a pipeline comprising:

a housing having at least one flow through passageway;

an annular seal disposed about the housing for sealing engagement with the pipeline and the housing; and closure means for variably closing and opening the flow through passageway.

In one embodiment, the pig includes a plurality of tubes disposed along the housing and defining a plurality of flow through passageways; and the closure means comprises at least one cap for closing at least one flow through passageway.

In a further embodiment, the invention includes adjusting means for adjusting the closure means in response to variations in the speed of the pig in the pipeline to maintain a desired speed of the pig.

The adjusting means may comprise:

sensor means for producing first signals indicative of the speed of the pig;

control means responsive to the first signals to produce control signals; and drive means responsive to the control signals for variably opening and closing the closure means.

The closure means may include:

a first plate disposed in the housing, the first plate having a plurality of first openings;

a second plate disposed in the housing, the second plate having a plurality of second openings;

relation to the first plate from a position in which at least some of the first and second openings are in fluid connection to a position in which substantially none of the first and second openings are in fluid connection.

In one embodiment, the first and second openings are disposed circumferentially around the first and second plates respectively to form a plurality of flow through passageways disposed circumferentially inside the housing and defining a central cavity.

The power supply may be disposed between the circumferentially disposed flow through passageways.

In another aspect of the invention, there is provided an annular seal comprising an arcuate section extending rearward and outward from the housing; and an angular section having a first part extending outward from the arcuate section and a second part extending rearward of the first part and having an outer surface concentric with the interior of the pipeline, the first and second parts meeting at an abrupt edge.

The arcuate section may initially extend substantially perpendicularly from the housing and includes forward and rearward substantially parallel edges, and the angular section commences rearward of the initial part of the rearward edge of the arcuate section, and the second part of the angular section terminates in a reverse angle.

In accordance with another aspect of the invention there is provided a method of controlling the speed of a pig in a pipeline comprising:

determining the actual speed of the pig;

variably controlling the size of a flow through passageway in the pig in response to determining the speed of the pig.

Preferably, variably controlling the size of the flow through passageway comprises:

pre-selecting a desired speed of the pig;

comparing the desired speed of the pig with the actual speed and decreasing the size of the flow through passageway when the actual speed is lower than the desired speed by a pre-set amount and increasing the size of the flow through passageway when the actual speed is higher than the desired speed by a pre-set amount.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1:
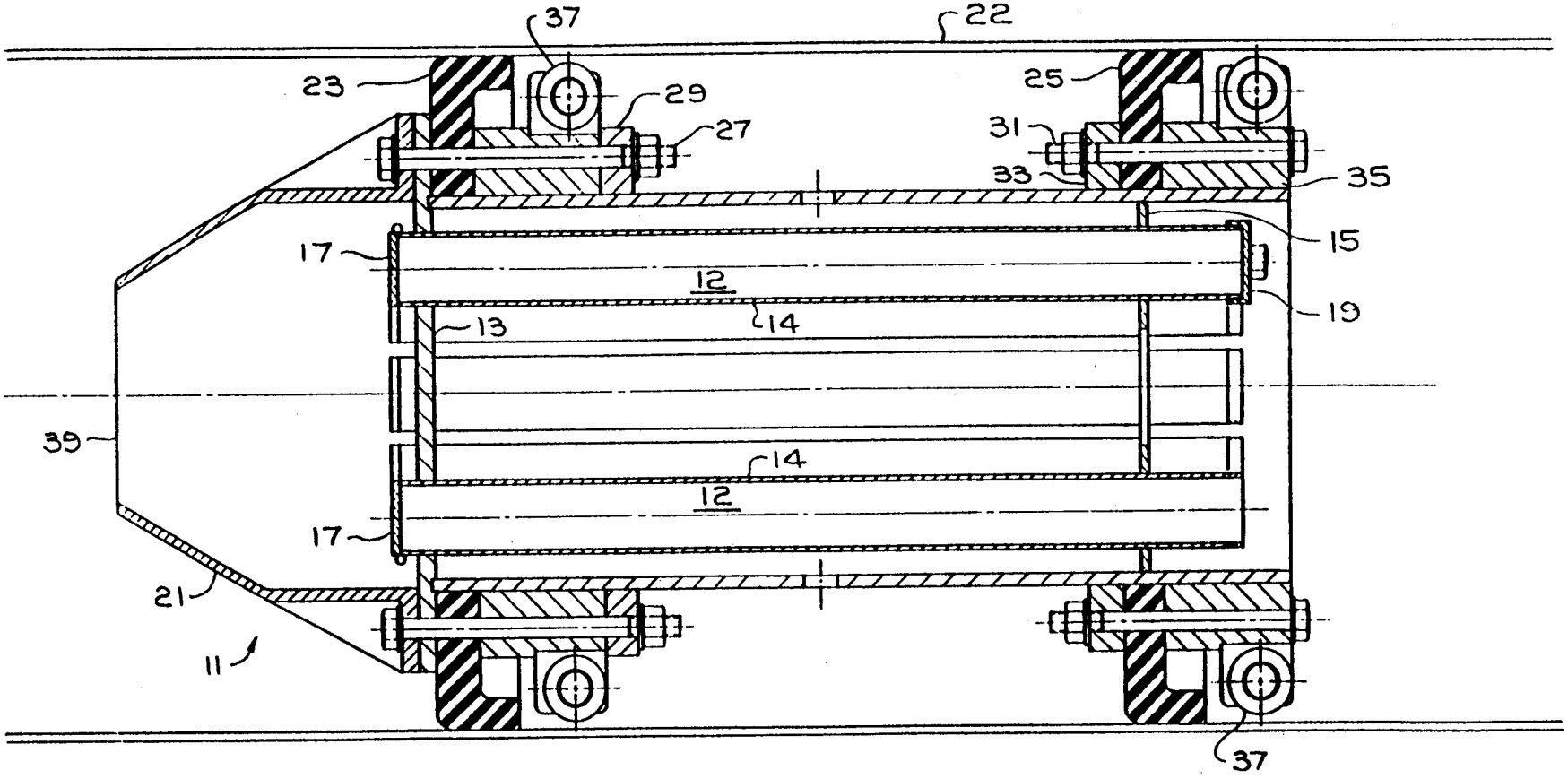
FIG. 1 is a section of a pig according to an aspect of the invention.

Referring to FIG. 1, there is shown a first embodiment of a pig according to the invention. A pig, designated generally by the numeral 11, is shown within a pipeline 22. The pig 11 is formed from a housing 10 with a plurality (here shown as 8) of flow tubes 14 defining flow through passageways 12 extending along the length of the housing 10. The forward ends of the tubes 14 are secured within and to the housing by a plate 13, and at the rearward end by a plate 15. At least one of the plates 13 and 15 is solid except for openings for the tubes 14 and the plates therefore prevent flow of pipeline gas through the pig 11 except through the tubes 14. At the forward end of each tube 14 is a spring loaded flapper 17. Selective ones of the tubes 14 include means for closing the flow through passageway defined by the tubes 14, shown here as a cap 19 at the rearward end of one of the tubes. The number of tubes 14 having caps is selected according to the desired number of tubes 14 that should be open to allow for a predetermined speed of the pig 11. The greater the number of tubes 14 that are open, the slower the pig will move, since the pig is propelled by gas in the pipeline 22.

The pig 11 further includes a nose cone 21, having a forward opening 39, and forward and rearward annular seals 23 and 25 respectively. The seal 23 is secured by a plurality of bolts 27 to plate 13 and flange 29 on the housing 10 Each of the seals 23 and 25 extends circumferentially around the housing 10 and is sealed against the housing 10 and pipeline 22. The seal 25 is secured by a plurality of bolts 31 to flanges 33 and 35. At each seal, a plurality of wheels 37. (here there are 16 of them at each seal), are disposed circumferentially around the housing 10 and secured to it by the bolts 27 for the forward wheels and bolts 31 for the rearward wheels. The wheels 37 are used to support the weight of the pig 11 if the annular seals 23 and 25 become compressed or worn during use. The preferred seals, however, are shown in FIG. 2.

For the pig shown in FIG. 1, the speed of the pig is pre-set before being placed in the pipeline by closing selective ones of the tubes 14, and the pig runs near that pre-set speed. The speed of the pig will actually vary due to fluctuations in the gas flow, obstructions in the pipeline and the condition L of the interior surface of the pipeline.

Figure 2:
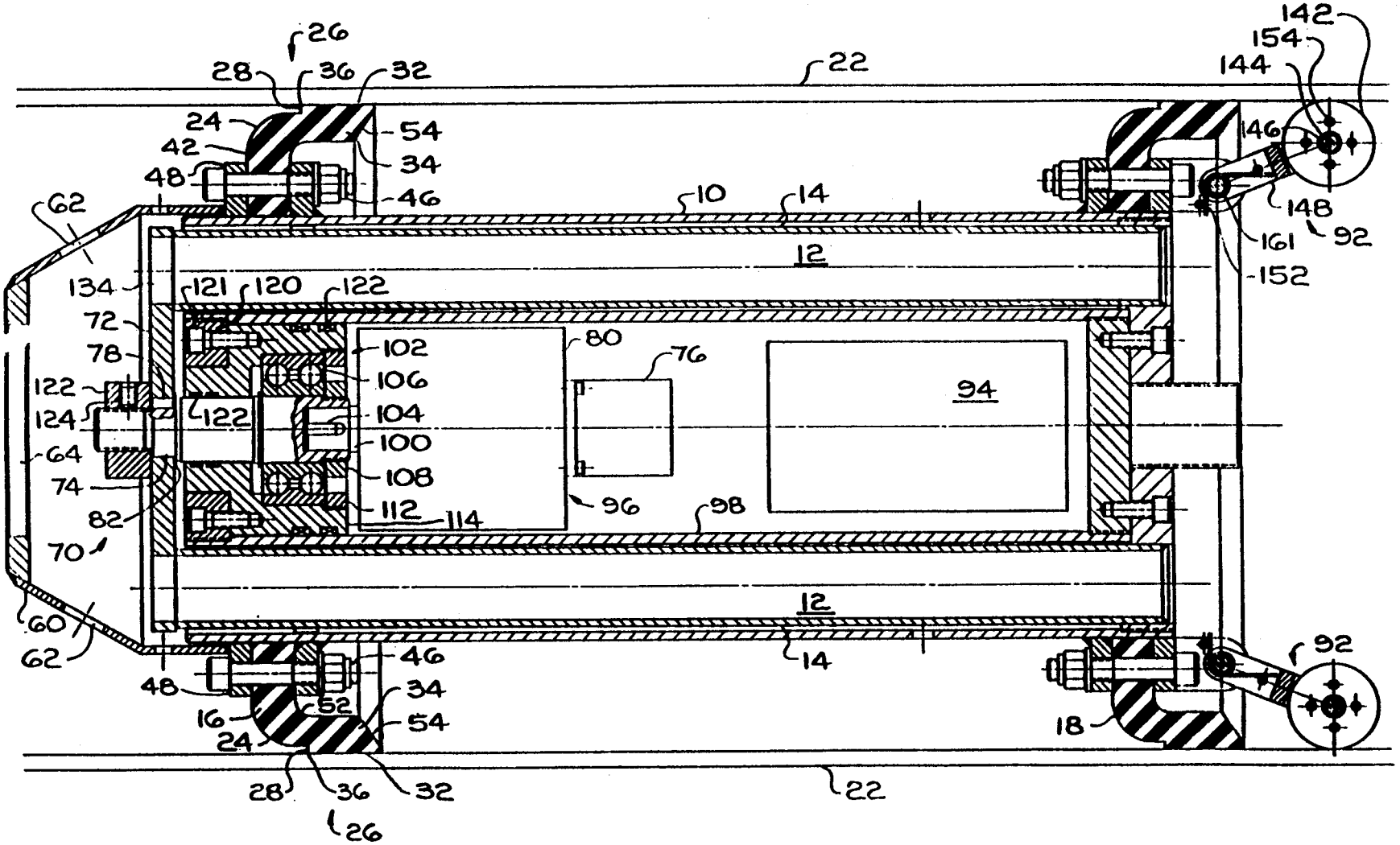
FIG. 2 is a section of a further embodiment of a pig according to the invention.
Figure 3:
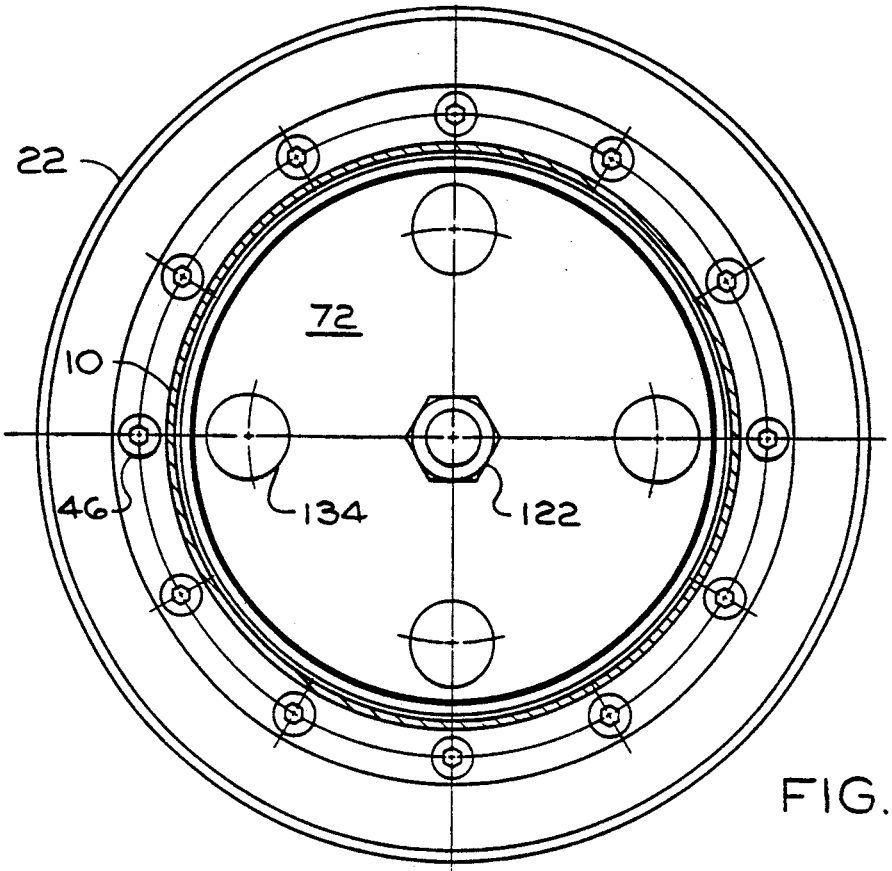
FIG. 3 is a front end sectional view of the pig of FIG. 2.
Figure 4:
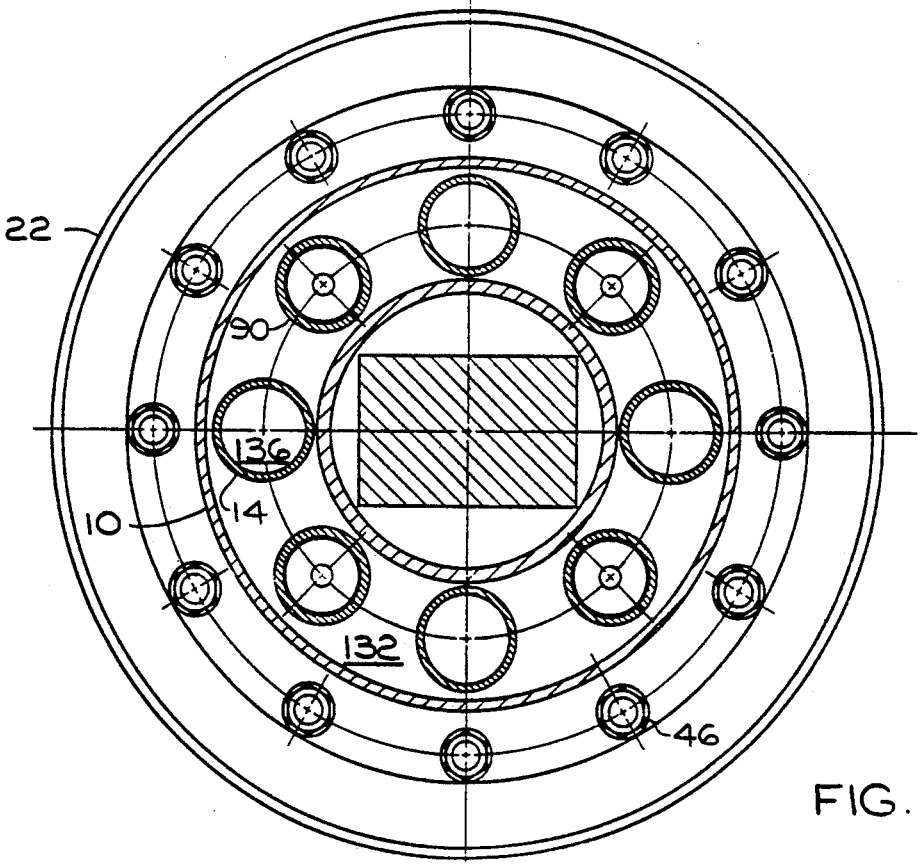
FIG. 4 is a rear end sectional view of the pig of FIG. 2.
Figure 5A:
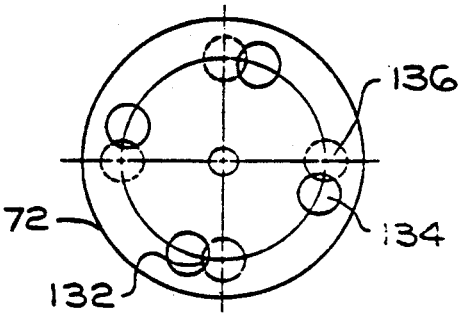
FIGS. 5A and 5B are front end views of the closure means of the pig of FIG. 2 showing partially open and closed positions.
Figure 5B:
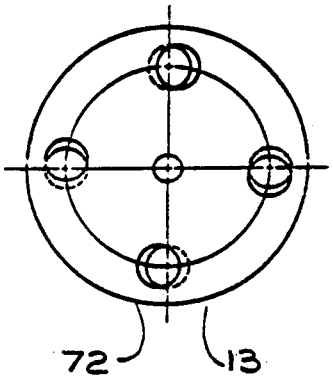

Referring now particularly to FIGS. 2 and 4, there is shown a further embodiment of a variable speed pig according to the invention in which the speed of the pig may be variably adjusted during use to compensate for the variable conditions inside the pipeline The pig of this embodiment has a housing or shell 10 in which there are shown a plurality of flow through passageways 12 defined by flow tubes 14. The flow tubes 14 are secured to the interior of the housing 10 and extend along its length.

Circumferentially disposed about the exterior of the housing 10 are forward and rearward annular seals 16 and 18 for sealing engagement with the pipeline 22 and the housing 10. The annular seals 16 and 18 (as with the seals 23 and 25) are preferably made of urethane, or other commonly available pig rubber.

The preferred structure of the annular seals 16 and 18 according to one aspect of the invention is as follows. Each seal has an arcuate section 24 extending rearward and outward from the housing 10 and an angular section 26 having a first part 28 extending outward from the arcuate section and a second part 32 extending rearward of the first part 28 and having an outer surface 34 concentric with the interior of the pipeline. The first and second parts 28 and 32 meet at an abrupt edge 36, which functions as a scraper for cleaning the interior surface of the pipeline 22. The arcuate section 24 allows the seals 16 and 18 to have the resiliency required to force the scraping edge 36 against the interior of the pipeline, even with the full weight of the pig compressing the seals. Thus these seals provide good flexibility with good sealing capability.

The arcuate section 24 initially extends substantially perpendicularly from the housing 10 and includes forward and rearward substantially parallel surfaces 42 and 44 that are secured to the housing 10 by bolts 46 secured to flanges 48. The angular section 26 preferably commences at 52 rearward of the initial part of the rearward surface 44 of the arcuate section 24. The second part 32 of the angular section 26 terminates in a reverse angle as shown at 54. The reverse angle enables the pressure of the propelling gas to force the rear end of the seal outward into a tight seal with the interior surface of the pipeline. As the outer part of the seal that is in contact with continues to force the seal against the pipeline. The seals so described may be used with either of the pigs shown in FIGS. 1 and 2.

Referring still to FIG. 2, the forward end of the housing 10 includes a cap 60 having openings 62 and 64 for allowing gas and liquid in the pipeline to flow out of the interior of the housing 10.

Referring more particularly to FIGS. 2, 3, 4 and 5A and 5B, the forward end of the housing 10 includes closure means 70 for variably closing and opening the flow through passageways 12. The closure means 70 includes a first orifice plate 72 disposed in the housing and secured to a shaft 74 for rotation with the shaft, which is connected through a gear reducer 80, for example a Bodine TM *model number* 2454, readily commercially available from, e.g., Soper's Supply Ltd. in Edmonton, Canada, to a step motor 76, for example a Bodine TM model number 2409, also readily commercially available from Soper's Supply. A key 78 on the shaft 74 is received by an appropriate slot in the plate 72. Shim 82 is placed between the plate 72 and the shoulder 84 on the shaft 74. As seen particularly in FIGS. 3, 5A and 5B, the plate 72 includes a plurality of first openings or orifices 134 that are alignable by rotation of the plate to be in fluid connection with the flow tubes 14. A second plate 132, shown particularly in FIG. 4, is disposed in the housing at the opposite end of the flow tubes 14 from the plate 72. A plurality of second openings or orifices 136 in the second plate 132 coincide with and are in fluid connection with the flow tubes 14.

Figure 6:
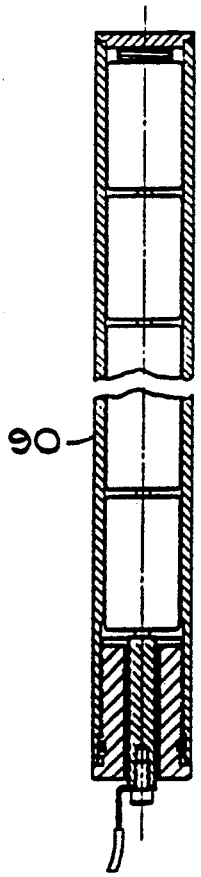
FIG. 6 is a section of a compartment for the storage of the power supply for the pig of FIG. 2.
Figure 7:
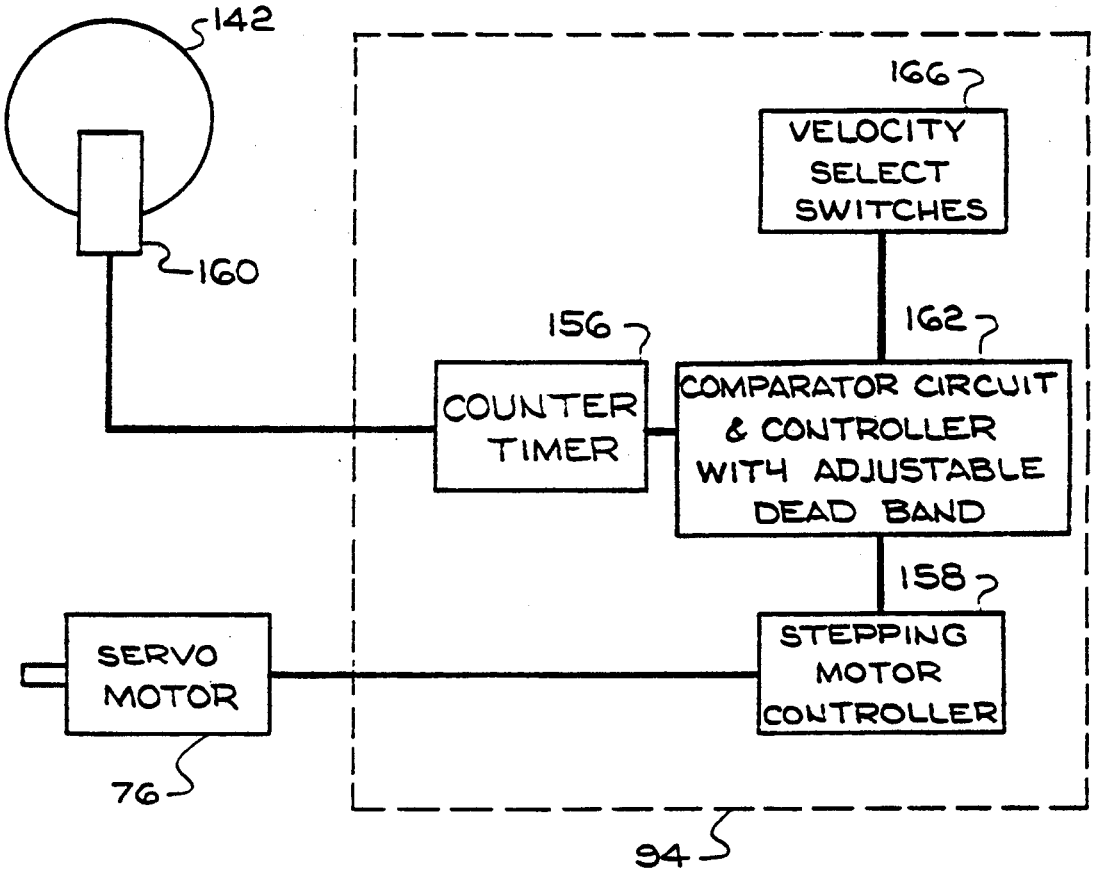
FIG. 7 is a schematic of the control system for the pig of FIG. 2.

The flow tubes 14, within the housing 10 alternate circumferentially around the interior of the housing 10 with a plurality of tubes 90 that carry the power supply, shown here as four sets of 8 "D" size dry cells. See particularly FIG. 6. Other orifices, alternating circumferentially with the orifices 136, in the second plate 132 allow for the removal of dry cells from the tubes 90. The flow tubes 14 and power supply tubes 90 define an interior cavity in which is located an interior case 98 that holds part of the control system and the drive system for the closure means.

Adjusting means for adjusting the closure means in response to variations in the speed of the pig in the pipeline to maintain a desired speed of the pig will now be described.

The closure means, and therefore the ease with which gas may pass through the flow tubes 14, is adjustably controlled by adjusting means which includes sensor means 92, control means 94 and drive means 96. The drive means 96 and control means 94 are secured within the drive case 98. The drive means 96 includes gear reducer 80, step motor 76 and the bearing system 102. The shaft of the step motor 76 extends into gear reducer 80 and thence to shaft 74 and the shaft 100 of the gear reducer is secured against rotation in the shaft 74 by key 104. The shaft 76 is journalled within bearings 106 secured within inner and outer bearing retainers 108 and 112, each secured within the bearing housing 114. The bearing housing 114 is secured to retaining ring 120 at the end of the drive casing 98 by bolts 121. The bearing system may be a SKF TM 3306E, readily commercially available. Seals 122 seal the bearing system 102. Nut 124 and set screw 126 secure the orifice plate 72 onto the shaft 74.

The drive means 96 is therefore connected with the first plate 72 through gear reducer 80 and shaft 74, and the first plate is thereby movable by the drive means in relation to the second plate and the flow tubes from a position in which at least some of the first and second openings are in fluid connection with each other to a position in which substantially none of the first and second openings are in fluid connection with each other. The flow tubes 14 and first and second sets of openings in the first and second plates together form a plurality of flow through passageways disposed circumferentially inside the housing. It will be observed that the second plate could be located at various positions longitudinally within the housing. The function of the second plate is to block off the movement of gas through the housing except through the flow through passageways.

The sensor means 92 is formed from odometer or pickup wheel 142 on shaft 144 with bushing 146. The wheel 142 is attached to the end of suspension arm 148 which is attached to the seal flanges 48 and thence to the housing 10 by pivot pin 161. The wheel 142 is held against the pipeline 22 by spring 152. As the pickup wheel in the sensor means rotates due to motion of the pig in the pipeline, four magnets 154 on the wheel pass a sensor or velocity encoder 160 on the suspension arm 148. The movement of a magnet past the sensor produces a pulsed signal whose frequency is indicative of the actual speed of the pig. The pulsed signal is fed to the control means 94. which includes counter 156, comparator and control circuit 162, stepping motor controller 158 and switches 166.

The pulsed signal from the encoder is fed to a frequency to the voltage converter or counter 156. The voltage output of the converter which will also be a signal indicative of the speed of the pig, is then fed to a comparator and control circuit 162. The comparator and control circuit 162 may have any of several configurations, but the object of the circuit is to provide control signals to the stepping motor controller that depend on whether the pig is travelling faster or slower than a pre-set speed by a pre-set amount.

The comparator and control circuit desirably carries out the following functions. By using the output of the counter and comparing it with the desired speed, it should provide a signal that is proportional to the magnitude of the difference between the actual and the desired speed. This signal may then be used to control the speed of the stepping motor so that it operates faster when the actual and desired speeds are far apart, and slower when they are closer together. With a similar comparison of the actual and desired speeds, the direction of the movement of the stepping motor should also be determined (that is, whether to open or close the flow through passageways) and fed to the stepping motor controller. The position of the plates must therefore also be tracked so that the contol means can control the amount of opening. Also, the controller should be set so that the stepping motor is only enabled when the actual speed differs from the desired speed by a pre-set amount, thus defining the deadband. Other features such as a bias so that the controller automatically sets the plates to the closed position on launch, and various safety features such as a means for determining when the wheels have become stuck, may also be incorporated.

The counter 156, comparator circuit 162 with adjustable dead band, and motor controller 158 together comprise a control means 94. The dead band is the range of speeds in which the control means will not respond to changes in the speed of the pig, so that the closure means is not being constantly adjusted during slight speed variations. If the desired speed is 7 mph, which would be typical for a typical 15 mph pipeline, then a typical dead band would be $6\frac{3}{4}$ mph to $7\frac{1}{4}$ mph. The desired speed and deadband may be set by the switches 166.

Thus, the signals that are indicative of the speed of the pig are compared in the comparator with the pre-set speed, and if they differ from the pre-set speed by a pre-determined amount (more than $\frac{1}{4}$ mph in the typical example given), a control signal is sent to the step motor controller 158, which in turn regulates the amount by which the plate 72 is rotated. This variably opens and closes the closure means. Both the drive means 96 and the control means 94 are disposed in the central cavity of the housing. The required movement of the step motor for a given speed variation may be readily determined.

The wheel 142 and encoder 160 measure the actual speed of the pig and the signals created by them, as with the output from the counter, are indicative of this speed. The control means 94 and drive means 96 variably control the size of the flow through passageways in the pig in response to the measurement of the speed of the pig. The collective effective cross-sectional areas (size) of the flow through passageways is decreased when the actual speed is lower than the desired speed by more than the pre-set amount, thus allowing less gas to by-pass the pig, and increased when the actual speed is higher than the desired speed by a pre-set amount, thus allowing more gas to by-pass the pig.

ALTERNATIVE EMBODIMENTS

A person skilled in the art could make immaterial modifications to the invention described and claimed in this patent without departing from the essence of the invention.

I claim:

1. A variable speed pig for a pipeline comprising:

a cylindrical housing having a first open end and a second open end;

an annular seal disposed about the housing for sealing engagement with the pipeline and the housing;

closure means disposed within the housing including a first plate disposed in the housing, the first plate having a plurality of first openings, and a second plate disposed in the housing, the second plate having a plurality of second openings and being disposed in the housing to block the flow of fluid through the housing except through the plurality of second openings, the first openings including means extending into contact with the second openings and defining flowthrough passageways;

sensor means for producing first signals indicative of the speed of the pig;

control means responsive to the first signals to produce control signals;

drive means responsive to the control signals for operating the closure means; and the first plate being movable by the drive means in relation to the second plate from a position in which at least some of the first openings are aligned with the second openings with fluid communication between respective ones of the first and second openings being provided by the flowthrough passageways to a position in which substantially none of the first openings are aligned with the second openings.

2. The variable speed pig of claim 1 in which the first and second openings are disposed circumferentially around the first and second plates respectively, in which:

the means defining the flowthrough passageways include a plurality of tubes extending between respective ones of the first and second openings, whereby the first and second openings and the tubes form flow through passageways, which are disposed circumferentially inside the housing, and the passageways define a central cavity.

3. The variable speed pig of claim 2 in which the drive means and the control means are disposed in the central cavity.

4. The variable speed pig of claim 3 in which the power supply is disposed between the circumferentially disposed flow through passageways.

5. The variable speed pig of claim 1 in which the annular seal comprises:

an arcuate section extending outward and rearward from the housing; and an angular section having a first part extending outward from the arcuate section and a second part extending rearward of the first part and having an outer surface concentric with the interior of the pipeline, the first and second parts meeting at an abrupt edge.

6. The variable speed pig of claim 5 in which the arcuate section initially extends substantially perpendicularly from the housing and includes forward and rearward substantially parallel edges, and the angular section commences rearward of the initial part of the rearward edge of the arcuate section.

7. The variable speed pig of claim 5 in which the second part of the angular section terminates in a reverse angle.

8. A pig for a pipeline comprising:

a housing having at least one flow through passageway;

an annular seal disposed about the housing for sealing engagement with the pipeline and the housing;

the annular seal having an arcuate section extending outward and rearward from the housing; and an angular section having a first part extending outward from the arcuate section and a second part extending rearward of the first part and having an outer surface concentric with the interior of the pipeline, the first and second parts meeting at an abrupt edge;

the arcuate section initially extending substantially perpendicularly from the housing and including forward and rearward substantially parallel edges, and the angular section commencing rearward of the initial part of the rearward edge of the arcuate section.

9. The variable speed pig of claim 8 in which the second part of the angular section terminates in a reverse angle.

10. An annular seal for a pig for a pipeline, where the pig includes a housing, the seal comprising:

an arcuate section extending outward and rearward from the housing; and an angular section having a first part extending outward from the arcuate section and a second part extending rearward of the first part and having an outer surface concentric with the interior of the pipeline, the first and second parts meeting at an abrupt edge;

the arcuate section initially extending substantially perpendicularly from the housing and including forward and rearward substantially parallel edges, and the angular section commencing rearward of the initial part of the rearward edge of the arcuate section.

11. The annular seal of claim 10 in which the second part of the angular section terminates in a reverse angle.

* * * * *

UNITED STATES PATENT AND TRADEMARK OFFICE

CERTIFICATE OF CORRECTION

PATENT NO. : 5,208,936

DATED : May 11, 1993

INVENTOR(S) : D. C. Campbell

It is certified that error appears in the above-indentified patent and that said Letters Patent is hereby corrected as shown below:

| COLUMN | LINE | |
|---|---|---|
| 1 | 52 | before "relation" insert --the second plate being movable by the drive means in-- |
| 3 | 26 | after "condition" delete "L" |
| 4 | 3 | after "with" insert --the pipeline wears out, the pressure from the gas-- |

Signed and Sealed this

Fifteenth Day of February, 1994

*Attest:*

Bruce Lehman

BRUCE LEHMAN

*Attesting Officer*

*Commissioner of Patents and Trademarks*